United States Patent [19]

Rose

[11] 4,152,565

[45] May 1, 1979

[54] BCD SLIDE-SWITCH

[75] Inventor: William H. Rose, Harrisburg, Pa.

[73] Assignee: AMP Incorporated, Harrisburg, Pa.

[21] Appl. No.: 874,286

[22] Filed: Feb. 1, 1978

[51] Int. Cl.[2] ..... H01H 15/00; H01H 9/00

[52] U.S. Cl. ..... 200/291; 200/292; 200/16 A

[58] Field of Search ..... 200/292, 164 R, 165, 200/252, 275, 327, 16 R, 16 A, 291

[56] References Cited

U.S. PATENT DOCUMENTS

| | | | |
|---|---|---|---|
| 3,052,763 | 9/1962 | Nathe | 200/275 X |
| 3,355,565 | 11/1967 | Daul | 200/291 |
| 3,843,852 | 10/1974 | Lockard | 200/16 D |
| 3,857,000 | 12/1974 | Boulanger | 200/252 X |
| 3,858,012 | 12/1974 | Lockard | 200/16 D |
| 3,888,807 | 6/1975 | Lockard | 200/16 R |
| 3,983,355 | 9/1976 | Hyodo | 200/16 R X |

*Primary Examiner*—William Price
*Assistant Examiner*—Steven M. Pollard
*Attorney, Agent, or Firm*—Gerald K. Kita

[57] ABSTRACT

A miniature switch of the type having a housing containing a planar circuit with electrical leads projecting outwardly of the housing for pluggable connection includes a manually slideable carriage having contacts which selectively engage the circuit. The carriage is inertially balanced to withstand accidental displacement or damage when subjected to mechanical shock and vibration.

3 Claims, 7 Drawing Figures

BCD SLIDE-SWITCH

BACKGROUND OF THE ART

The present invention relates to manually actuated slide switches which have an internal circuit such as exemplified in U.S. Pat. No. 3,888,807. Slide switches may be miniaturized, as disclosed in U.S. Pat. No. 3,858,012, for pluggable use on a circuit board. In addition, miniature slide switches of the pluggable type include some means for registration of a carriage within a series of detents as disclosed in U.S. Pat. No. 3,843,852. In order to retain the carriage in a detented position, substantial gripping pressures are usually required. In addition, substantial contact pressures are required to insure retention of a contact carried by the carriage against the internal circuit. Slideably traversing the contact over the surface of the internal circuit causes substantial wear. As recognized by U.S. Pat. No. 3,888,807, the carriage is manually lifted to disengage the contact from the internal circuit prior to moving the carriage.

In design of a slide switch, it is desirable to provide a minimum necessary contact pressure against the internal circuit allowing the contact to slideably traverse over the circuit without causing excessive wear. However, vibration or inadvertent impact may disturb the light contact pressure, causing the contact to chatter or perhaps be deflected momentarily to produce an undesired electrical shorting or undesired electrical connection.

BRIEF DESCRIPTION

In the present invention, the mass of the carriage is maintained at a relatively low level to reduce inertia effects from vibration. Metal portions of the carriage contribute largely to the overall mass. A spring-loaded ball detent device carried on the carriage extends through a central axis of the carriage transversely from one side to the other. A metal contact mounted on the carriage included a plurality of projecting portions for slideable engagement with the internal circuit. The projecting portions are linearly aligned along an axis which is in parallel alignment with the central axis of the detent mechanism. Thus the contact pressure against the internal circuit is transmitted to the carriage in a manner evenly distributed along the central axis which permits the carriage to be inertially balanced when assembled in the switch. The inertially balanced carriage will retain its desired position in the switch assembly allowing a reduction in contact pressure against the internal circuit. Further, the retention forces surrounding the carriage to retain the same in desired detented position can be reduced, allowing smoother manual actuation of the carriage with less effort necessary to overcome the detent and retention forces.

OBJECTS

An object of the present invention is to provide a manually actuated switch of miniature size wherein a carriage is slidably traversed to one of a number of detented positions, the carriage being inertially balanced to resist chatter and permit substantial reduction of abrasion wear and retention forces on the assembled parts.

Another object of the present invention is to provide a miniature slide actuated switch having a carriage provided with a detent mechanism passing through a central axis of the carriage and wherein the carriage has mounted thereon, a contact having a plurality of projecting portions for slideably engaging an internal circuit of the switch, which projecting portions are distributed along an axis in parallel alignment with the central axis to allow inertial balancing of the carriage.

Other objects and many attendant advantages of the present invention will be apparent from the following detailed description taken in conjunction with the accompanying drawings.

DRAWINGS

DETAILED DESCRIPTION

Figure 1:
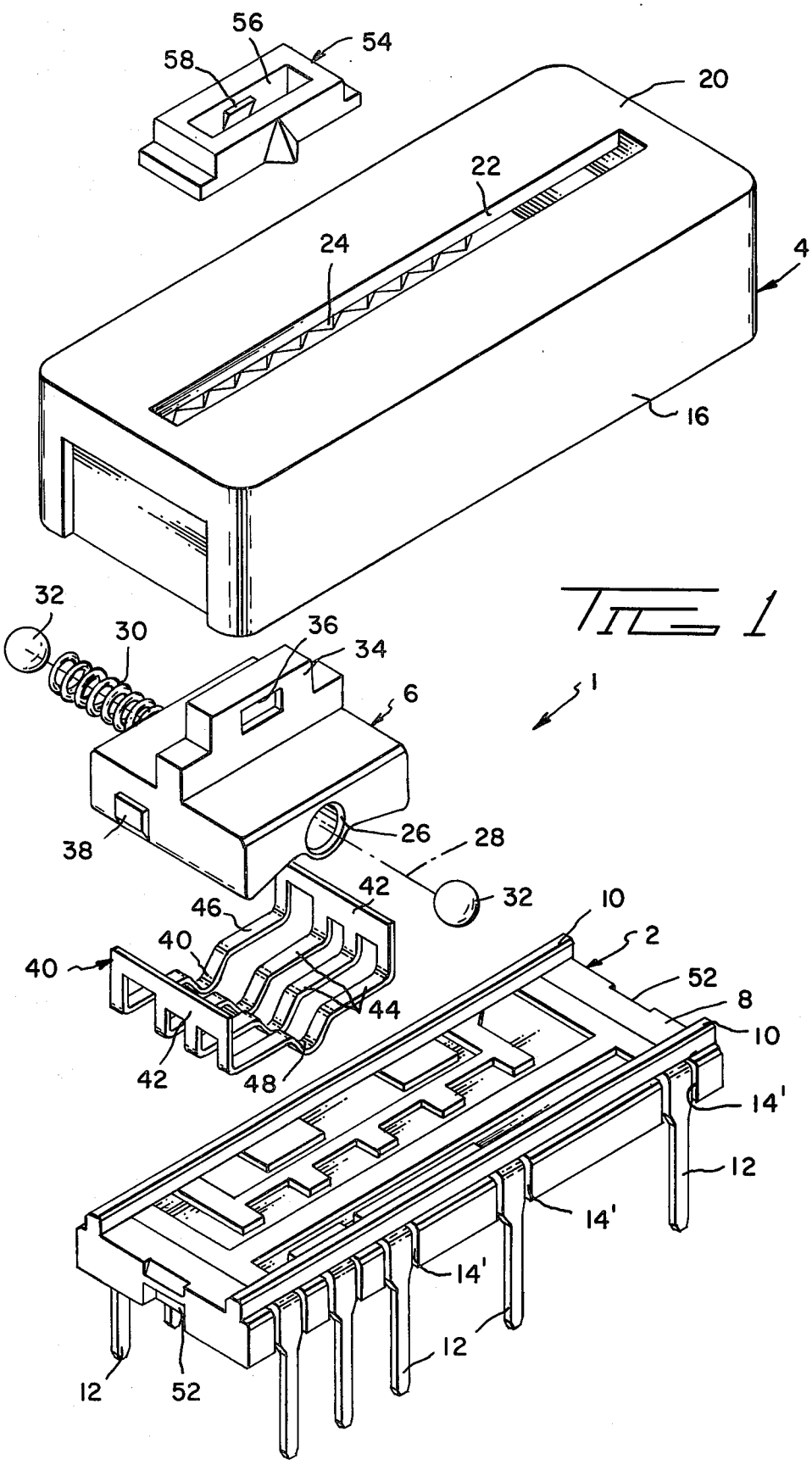
FIG. 1 is an enlarged perspective of a preferred embodiment according to the present invention with parts exploded to illustrate the details thereof.
Figure 2:
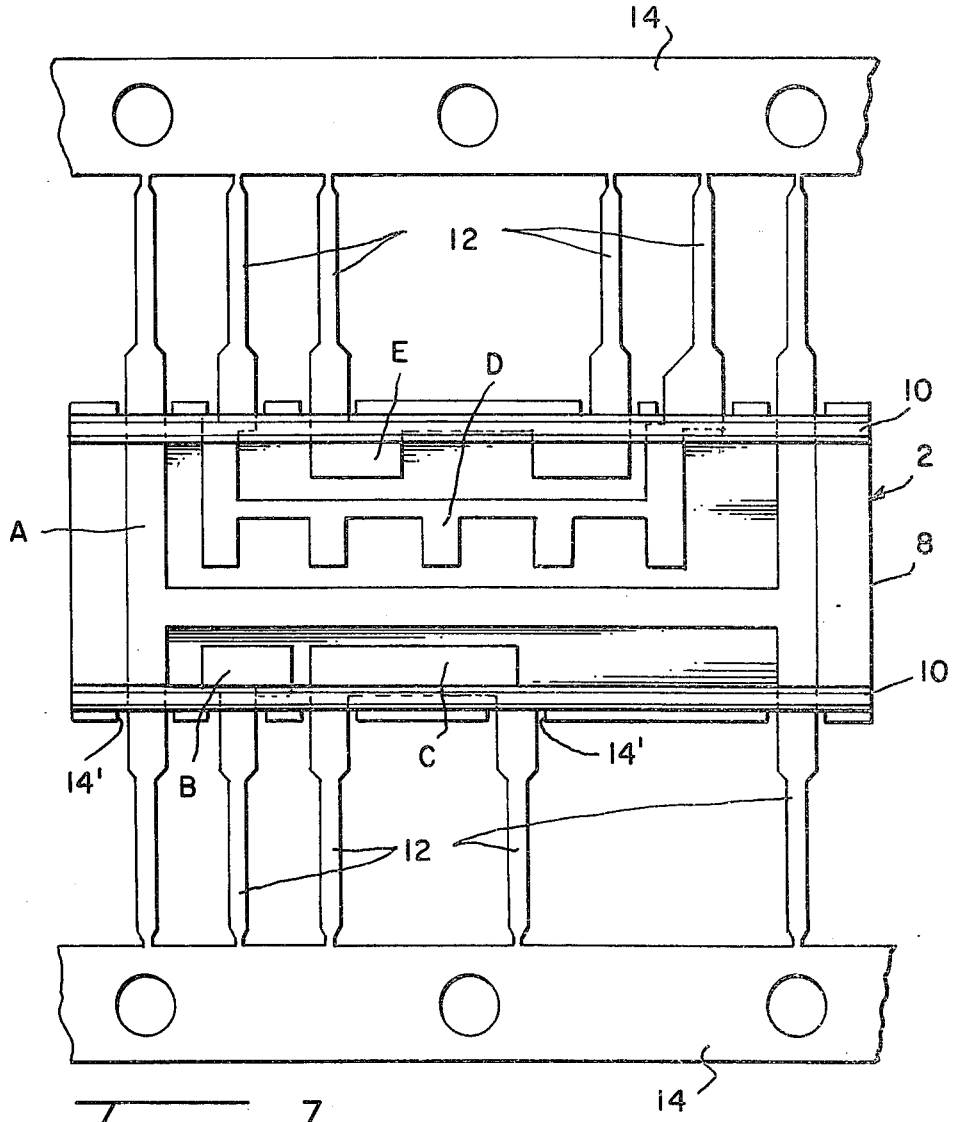
FIG. 2 is an enlarged plan view of a base portion of the switch illustrating the details of an internal circuit.

With more particular reference to the drawings, there is shown generally at 1 a preferred embodiment of a switch according to the present invention comprising a base portion shown generally at 2, a cover portion generally at 4, and a carriage portion indicated generally at 6. FIGS. 1 and 2 illustrate the details of the base portion which is molded from a rigid dielectric material having a planar bottom surface 8 and a pair of projecting elongated rails 10 which are parallel and disposed along opposite sides of the base 2. The switch is provided with internal circuitry in the form of metal strips A, B, C, D, and E, disposed flat against the bottom wall 8. As shown, the strips project above the surface 8. Alternatively, if desired, they can be embedded so that they are flush with the bottom wall 8. More particularly, by injection molding, the strips are located in place as desired, flush or projecting from the base 2. The metal strips are provided with integral projecting lead portions 12 which project outwardly of opposite sides of the base 2 with the rails 10 overlying the leads 12. As shown in FIG. 2, initially, the leads 12 and the metal strips are coplanar and may be attached to carrier strips 14'. Subsequent to injection molding, the carrier strips 14' may be removed and the leads 12 bent out of the plane of the metal strips in depending relationship with respect to the base 2 as shown in FIG. 1. In addition, the opposite sides of the base 2 may be molded with vertical grooves some of which are shown at 14 into which the bent leads may register when bent.

Figure 3:
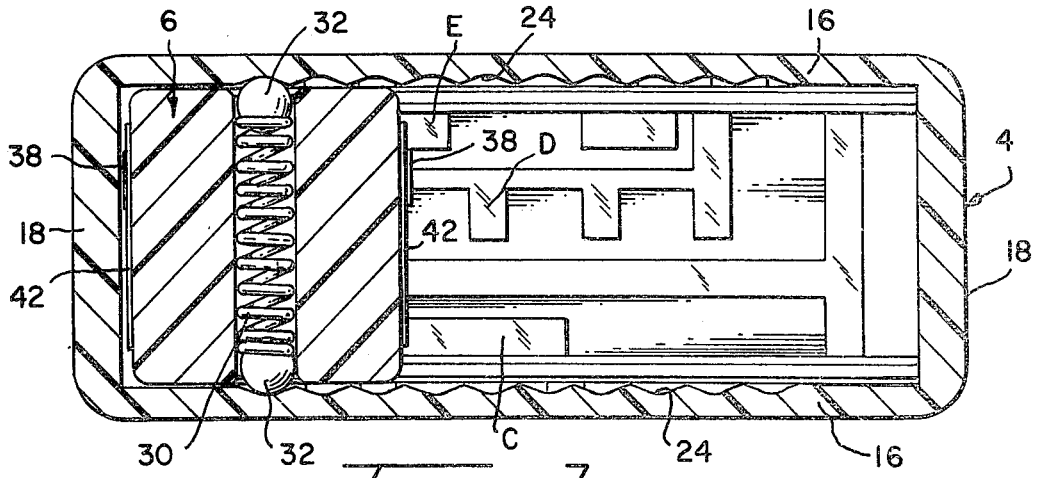
FIG. 3 is an enlarged plan view in section of the assembled switch parts.
Figure 4:
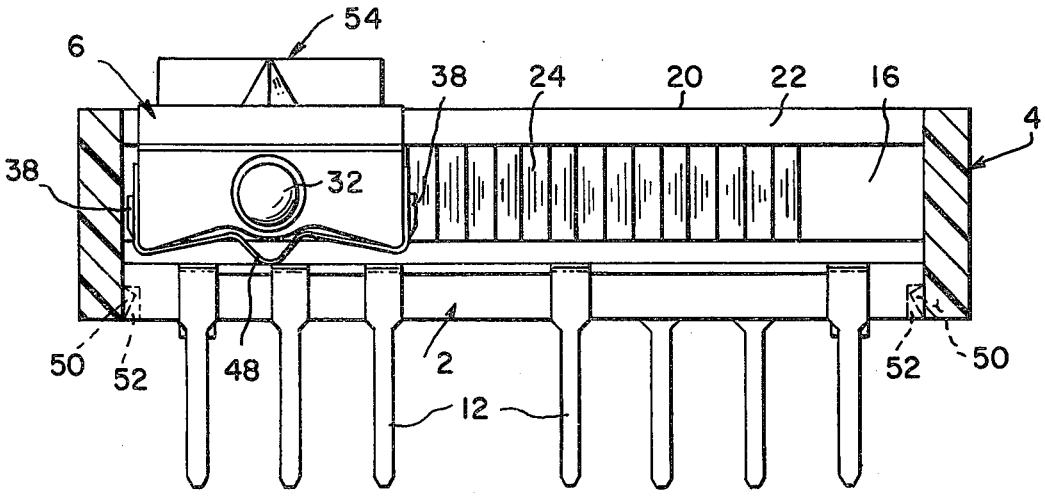
FIG. 4 is an enlarged elevation in section of the assembled switch parts.

The cover 4 is generally of inverted box configuration and is shown more particularly in FIGS. 1, 3, and 4. The cover 4 is molded from a rigid dielectric material and is provided with elongated sidewalls 16, integrally connected end walls 18, and a top wall 20 provided with an elongated narrow slot 22 therethrough. The sidewalls 16 are molded with a series of recessed detents 24 extending along the longitudinal dimensions of the walls 16.

The carriage comprises a generally rectangular block of molded rigid dielectric provided with a transverse bore 26 extending along a central transverse axis 28. A detent mechanism comprising an elongated coiled spring 30 and a pair of metal spherical balls 32 seated against opposite ends of the spring 30 are mounted in the bore 26 and along the axis 28.

The block is provided with an integral molded latching member 25 of a width to slideably traverse along the slot 22 of the cover 4. The projection 25 also is disposed in a central longitudinal plane of the block. The carriage 6 is substantially symmetrical about the central longitudinal plane except for a pair of very small projecting latch members 38. The carriage also includes a metal electrical contact illustrated generally at 40. The contact is stamped and formed of one-piece from a resilient metal strip into a ladder-like configuration having two spaced sidestrips 42 connected by a series of parallel contact strips 44 and 46. Each of the contact strips 44 and 46 are formed or bent to provide U-shaped projections 48 which are in alignment with each other along an axis generally parallel to the sidestrips 42. The contact 40 is mounted to the block by hooking the strips 42 over the projections 38, the projections 38 fitting into the space between the contact strip 46 and an adjacent contact strip 44. As shown more particularly in FIG. 1, the contact strips 44 are spaced closer together than the contact strips 46. When the contact 40 is mounted to the block, therefore, the weight of the strips 44 are offset to one side of the longitudinal central plane of the carriage 6 while the mass of the latching projections 38 are offset to an opposite side of the plane. The carriage thereby is substantially balanced along the central longitudinal plane. Further, the switch is inertially balanced about a vertical plane passing along the transverse central axis 28. The switch is assembled by inserting the projection 34 through the slot 24 of the cover, registering the ball detents 32 in corresponding detents 24. The contact 40 will be received freely in the space between the rails 10 of the base 2. The carriage block will register on top of the rails 10. The contact projections 48 engage slideably against the circuit portions. The pressure of the projections 48 against the circuit portions are transmitted to the carriage. The projections 48 are in alignment with each other and are in parallel alignment with the central axis 28. Accordingly, the force of the circuits against the projections are distributed transversely from side to side of the carriage and are also transmitted vertically upward to pass through the axis 28. Such forces therefore do not upset the desired inertial balance about a plane passing through the axis 28.

As shown in FIG. 4, the end walls of the cover are provided with internal wedge-shaped projections 50 which latch into corresponding recesses 52 of the base bottom wall 8. To complete the assembly, an actuator bezel indicated generally at 54 is latchably secured to the projection 34. More particularly, the projection 34 is received in a central aperture 56 of the bezel. Projections 58 are molded to project into the aperture 56 for latching within the recesses 36 of the projection 34.

Figure 5:
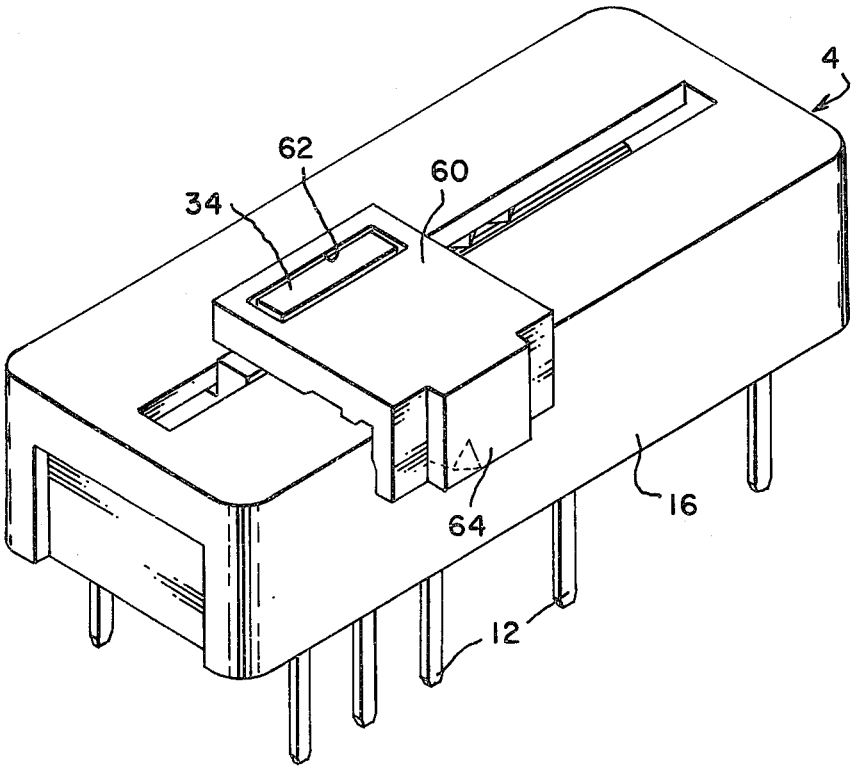
FIG. 5 is an enlarged perspective illustrating a modified actuator of a switch according to the present invention.

FIG. 5 shows a modification whereby a bezel 60 having an aperture 62 receiving the projection 34 therein has a portion 64 serving as a pointer to overlie a sidewall 16 of the cover 4.

Figure 6:
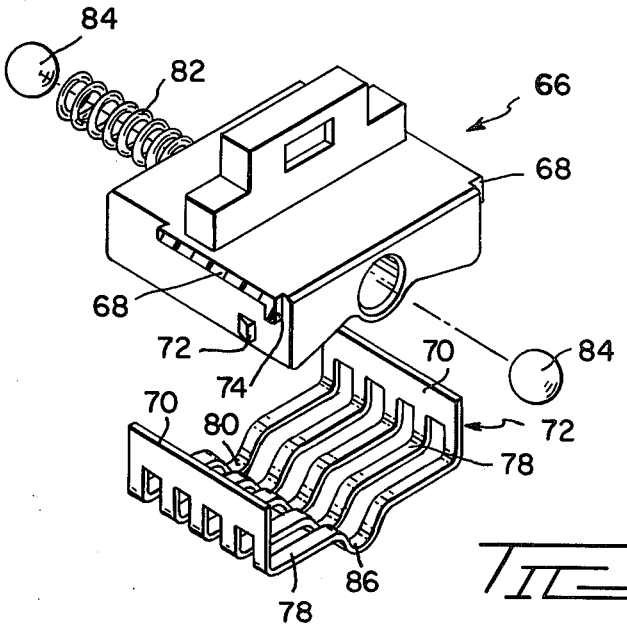
FIG. 6 is a perspective of a modified carriage of a switch according to the invention.

As shown in FIG. 6, a modified carriage 66 is molded of solid dielectric material and provided with a pair of integral inverted pockets 68 which receive therein corresponding side strips 70 of a contact 72, when the contact is assembled to the carriage. The side strips 70 seat against a molded end wall 74 of each pocket and hook over molded projections 76. The contact 72 is provided with five spring contact portions 78 having formed projecting portions 80 in mutual alignment and in parallel alignment with an elongated coil spring 82 and ball detents 84, similar to the previously described carriage. Five, rather than four, spring contact portions permit easier adjustment in weight distribution to achieve inertia balancing of the carriage 66.

Figure 7:
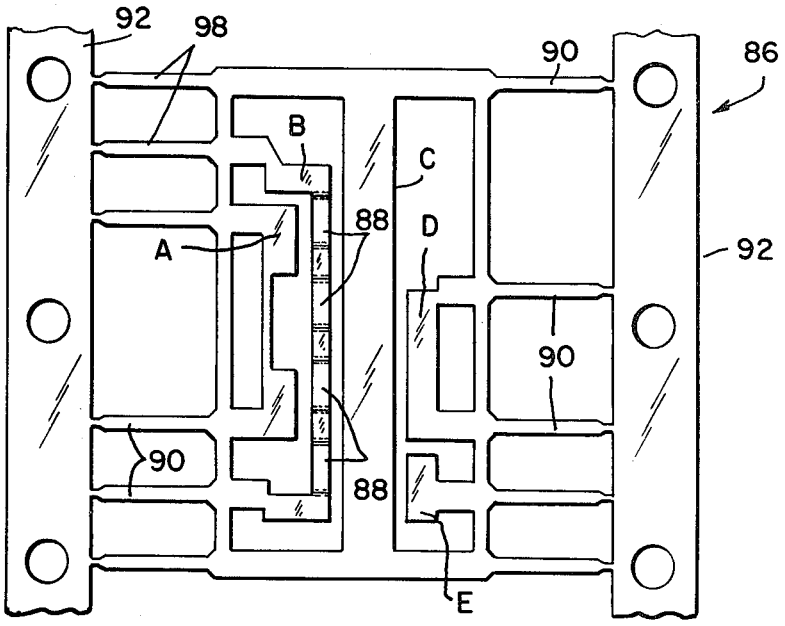
FIG. 7 is a plan view of a modified internal circuit.

FIG. 7 shows a modified internal circuit 86 for use with the carriage of FIG. 6. The circuit includes circuit portions A, B, C, D, and E slidably engaged by the five contact portions 80 when the circuit and carriage are assembled in a switch housing such as that formed by the base and cover portion similar to the previous embodiment. As in the previous embodiment, the circuit portions may be embedded in a molded dielectric base. Some portions 88 of the portion B may be recessed and thereby embedded internally of the molded base material to prevent contact with the contact portions 80 but to provide electrical continuity throughout the circuit portion B. The circuit also includes electrical lead portions 90 which are attached to removable carrier strips 92.

Other modifications and embodiments of the present invention which would be obvious to one having ordinary skills in the art is intended to be covered by the spirit and scope of the appended claims.

What is claimed is:

1. In a switch having a planar circuit contained in a housing and a manually actuated carriage having a contact engaged on said planar circuit and traversed selectively over said circuit upon movement of said carriage, the improvement comprising:

said carriage having detent means therein extending through said carriage from one side thereof to the other, said detent means engaging opposite sides of the said housing, said housing sides being provided with a series of recessed detents receiving said detent means, said contact extending from one side of said carriage to the other and having a plurality of projecting portions in parallel alignment with said detent means and engaging portions of said circuit in parallel alignment with said detent means.

2. The structure as recited in claim 1, wherein, said carriage includes latching means offset to one side of a longitudinal axis of said carriage, said contact being secured to said latching means and the mass center of said contact is offset to another side of said longitudinal axis.

3. The structure as recited in claim 1, wherein, said carriage is of dielectric material having a relatively low mass in comparison to the mass of said detent means.

* * * * *